US005480027A

United States Patent [19]

Leonard

[11] Patent Number: 5,480,027

[45] Date of Patent: Jan. 2, 1996

[54] STACKABLE AND DISPOSABLE TOOTHBRUSH HOLDER

[76] Inventor: Marilyn K. Leonard, 1811 S. Quebec Way, Apt. 246, Denver, Colo. 80231

[21] Appl. No.: 203,309

[22] Filed: Mar. 1, 1994

[51] Int. Cl.[6] ..... B65D 85/20

[52] U.S. Cl. ..... 206/362.1; 206/362.2

[58] Field of Search ..... 206/362, 362.1, 206/362.3, 362.4, 362.2, 216, 217; D6/528, 529, 530, 531, 534; 229/1.5 B, 242

[56] References Cited

U.S. PATENT DOCUMENTS

| | | | |
|---|---|---|---|
| D. 286,349 | 10/1986 | Bussell | D6/534 |
| D. 287,320 | 12/1986 | Bussell | D6/534 |
| D. 309,840 | 8/1990 | Estvold | D6/534 |
| D. 326,383 | 5/1992 | Tapocik | D6/534 |
| D. 327,195 | 6/1992 | Murphy et al. | D6/534 |
| D. 327,800 | 7/1992 | Hollinger | D6/534 |
| 1,507,466 | 9/1924 | Collins . | |
| 1,633,834 | 6/1927 | Vaitulis . | |
| 2,527,931 | 10/1950 | Iskoe . | |
| 3,845,897 | 11/1974 | Buttery et al. | 229/1.5 B X |
| 4,412,644 | 11/1983 | La Fever | 229/1.5 B |
| 4,518,639 | 5/1985 | Phillips | 229/1.5 B X |
| 4,817,826 | 4/1989 | Judge | 206/362.1 |
| 4,978,003 | 12/1990 | Foster | 206/217 |
| 5,297,677 | 3/1994 | Burian et al. | 206/362.1 |

*Primary Examiner*—Jacob K. Ackun

*Attorney, Agent, or Firm*—Edwin H. Crabtree; Donald W. Margulis; Ramon L. Pizarro

[57] ABSTRACT

A disposable and stackable toothbrush holder for holding one or more of various size toothbrushes in up upright position. The toothbrush holder allowing the toothbrush to air dry. The shape of the holder is in the form of an upside down drinking cup with openings or lines of weakness for providing openings in an upper portion of the cup. The openings are used for receiving a handle of the toothbrush therethrough. The cup provides a stable base which has a diameter greater than a diameter of the upper portion of the cup so that the holder does not tip over when in use. The holder is stackable with other identical holders for ease in shipping and storage. Paper, plastic and like materials may be used in making the holders into various geometric shapes such as a "cone shaped", a "tapper cylindrical shape", etc. The structure of the toothbrush holder provides a safe and sanitary means for holding the toothbrush head and bristles free from the surface of a bathroom vanity in a hotel, motel, and other travel locations that are foreign to the toothbrush users home.

12 Claims, 1 Drawing Sheet

STACKABLE AND DISPOSABLE TOOTHBRUSH HOLDER

BACKGROUND OF INVENTION (a) Field of the Invention

This invention relates to a toothbrush holder and more particularly, but not by way of limitation, to a toothbrush holder which is disposable and stackable for ease in use in hotels, motels and other locations when traveling away from home.

(b) Discussion of Prior Art

Heretofore there have been a variety of different types of toothbrushes holders. U.S. Pat. No. 2,527,931 to Iskoe illustrates a plurality of paper-type stackable cups, with the cups used for receiving a folder toothbrush in the bottom of each cup. The cups with toothbrush are adapted for dispensing from a coin-operated vending machine.

U.S. Pat. No. 4,978,003 to Foster illustrates a toothbrush holder having openings in the top of the holder for receiving toothbrush handles therethrough. A bottom portion of the holder is adapted for receiving a disposable cup therein. U.S. Pat. No. 1,507,466 to Collins discloses a holder for sterilizing toothbrushes and includes openings in a top cover for allowing vapor to escape from the holder.

U.S. Pat. No. 4,817,826 to Judge and U.S. Pat. No. 1,633,834 to Vaitulis described permanent type toothbrush holders. None of the above mentioned patents disclose a toothbrush holder have the unique features and advantages of subject invention which is now described.

SUMMARY OF THE INVENTION

In view of the foregoing, it is an object of the present invention to provide a toothbrush holder for holding one or more toothbrushes in an upright position away from a bathroom vanity surface that may or may not be sanitary. The toothbrush holder may be supplied by the toothbrush owner when traveling or may be furnished by a hotel, motel, or like establishment as a compliment to standard bathroom accessories such as soap, shampoo, drinking cups or glasses, towels, etc. Also, if desired, the subject invention may be used in home, hospital, nursing care facilities and the like for convenience, efficiency and sanitary purposes.

Another object of the invention is to provide a toothbrush holder which is inexpensive, simple in design and construction, and is stackable with identical holders for ease in shipping and storage. The holder may be made of paper, plastic, and similar types of material.

Still another object of the holder is an upper portion of the holder is adapted with a plurality of openings for holding more than one toothbrush in an upright position and allowing the bristles of the toothbrush to air dry free from any bathroom vanity surface.

Yet another object of the invention is that the holder is in the form of an upside cup wherein the upper portion of the holder rather than openings can have lines of weakness for use in providing openings for the handles of one or more toothbrushes. This embodiment of the holder can be used for a drinking cup or for holding a mouth wash prior to turning the cup upside down and using it as a toothbrush holder. The holder can be used once and thrown away or used more than once prior to being discarded.

The subject invention provides a disposable and stackable toothbrush holder for holding one or more of various size toothbrushes in an upright position. The toothbrush holder allows the toothbrush to air dry. The shape of the holder is in the form of an upside down drinking cup with openings or lines of weakness for providing openings in an upper portion of the cup. The openings are used for receiving a handle of the toothbrush therethrough. The cup provides a stable base which has a diameter greater than a diameter of the upper portion of the cup so that the holder does not tip over when in use. The holder is stackable with other identical holders for ease in shipping and storage. The toothbrush holder may be made of paper, plastic and like materials and formed into various geometric shapes.

There and other objects of the present invention will become apparent to those familiar with the use of both permanent and disposable toothbrush holders when reviewing the following detailed description, showing novel construction, combination, and elements as herein described, and more particularly defined by the appended claims, it being understood that changes in the precise embodiments to the herein disclosed invention are meant to be included as coming within the scope of the claims, except insofar as they may be precluded by the prior art.

BRIEF DESCRIPTION OF THE DRAWINGS

The accompanying drawings illustrate complete preferred embodiments of the present invention according to the best modes presently devised for the practical application of the principles thereof, and in which.

DESCRIPTION OF THE PREFERRED EMBODIMENTS

Figure 1:
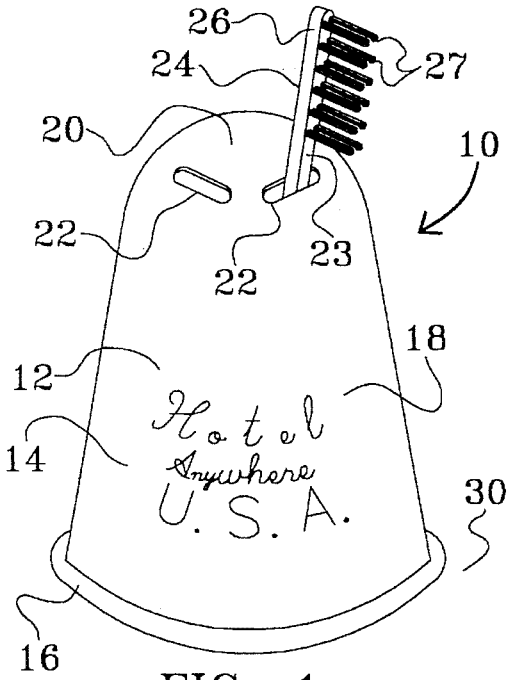
FIG. 1 is a perspective view of one embodiment of the subject disposable and stackable toothbrush holder and in the form of an upside down cup in a cone shape.

In FIG. 1, the disposable and stackable toothbrush holder is shown designated by general reference numeral 10. The holder 10 in this view is shown in the form of an upside down drinking cup 12 in the form of a hollow cone. The cup 12 includes a lower portion 14 with a rounded lip 16, a middle portion 18 and a rounded upper portion 20. The lower portion 14 with lip 16 act as a stable base to prevent the holder 10 from tipping over when holding one or more toothbrushes. This is accomplished by the lower portion 14 having a greater diameter than the diameter of the rounded upper portion 20.

The rounded upper portion 20 includes a plurality of holes 22 therein for receiving a handle 23 of a toothbrush 24 therethrough. The toothbrush 24 also includes a toothbrush head 26 with bristles 27 for brushing the teeth of the user of the subject invention. A lower end 28, shown in FIG. 4, of the handle 22 rests on top of a flat surface 30 used for receiving the holder 10 thereon. The flat surface 30 might be part of a wash basin, bathroom vanity and the like where people would normally store thereof toothbrushes during travel or at home.

In FIG. 1, the toothbrush 24, by design, is shown with the toothbrush head 26 and bristles 27 resting above the upper portion 20 and completely exposed for air drying after the use of the toothbrush 24. In this manner, the holder 10 provides a completely sanitary means of holding the toothbrush 24 free from any unsanitary surfaces nearby that have not been cleaned properly. In this view, the middle portion 18 of the holder 10 is used to advertise signage of a hotel.

Figure 2:
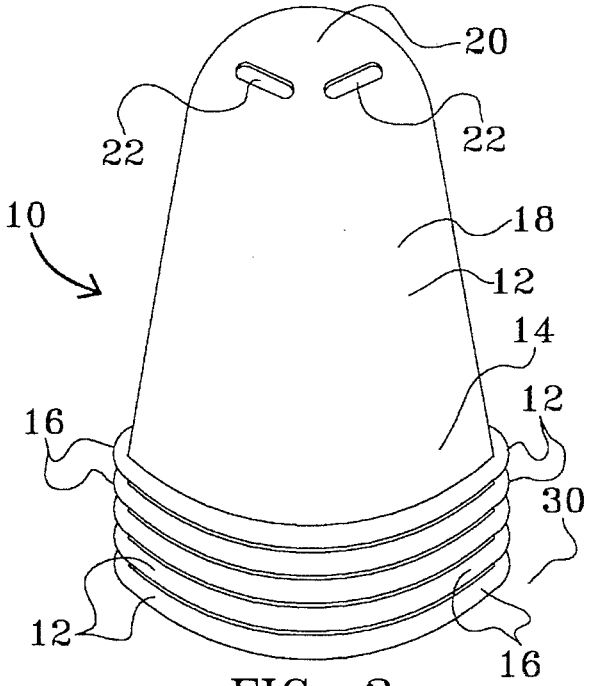
FIG. 2 is a front view of the toothbrush holder shown in FIG. 1 stacked on top of a plurality of identical toothbrush holders and ready for storage or receipt in a box for shipping.

FIG. 2 illustrates the holder 10 stacked on top of a plurality of identical holders 10. By stacking the holders 10 as shown, they can easily be inserted into shipping boxes for mailing to customers. Also, the stacked holders 10 can be stored in a storage closet or left in a bathroom for giving a travel guest more than one of the unique disposable toothbrush holders for ongoing use.

Figure 3:
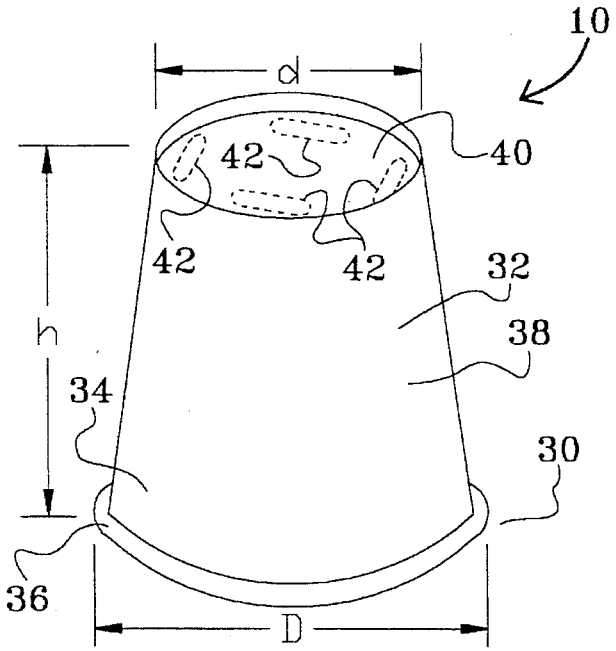
FIG. 3 is a perspective view of another embodiment of the subject invention and in the form of an upside down cup having a tapered cylindrical shape with lines of weakness in a flat upper portion of the holder.

FIG. 3 illustrate a perspective view of another embodiment of the subject toothbrush holder 10 in the form of an upside down cup 32 having a tapered cylindrical shape. In this example, the cup 32 also includes a lower portion 34 with a rounded lip 36, a middle portion 38, but with a flat upper portion 40 having annular shaped lines of weakness 42 therein. The lines of weakness 42 can be broken through by using a sharp object or pushed through using the lower end 28 of the toothbrush handle 23. The lines of weakness 42 are sized and shaped for forming holes 44 and receiving toothbrush handles 23 therethrough as shown in FIG. 4.

As mentioned above, it is desired to have the subject invention as stable as possible to prevent the toothbrush holder 10 with one or more toothbrushes 24 from tipping over during use. In this example, the lower portion 34 has a diameter "D" with the flat upper portion 40 having a diameter "d". The diameter "D" is greater than the diameter "d" so that when the holder 10 is shown turned upside down it is stable and won't easily tip over when in use. The diameter "D" may be more or less in a range of 2½ to 4 inches or greater depending on the size of holder 10 desired. The height of the holder 10 is shown as "h". The height "h"πmay be more or less in the range of 3 to 5 inches put ideally less than the length of the toothbrush handle 23 which is shown in FIG. 4 having a length "H". The length "H" is greater than the height "h" and more or less in the range of 5 to 7 inches so that the bristles 27 do not come in contact with the flat upper portion 40 for sanitary reasons and all of the bristles 27 are free to air dry.

Figure 4:
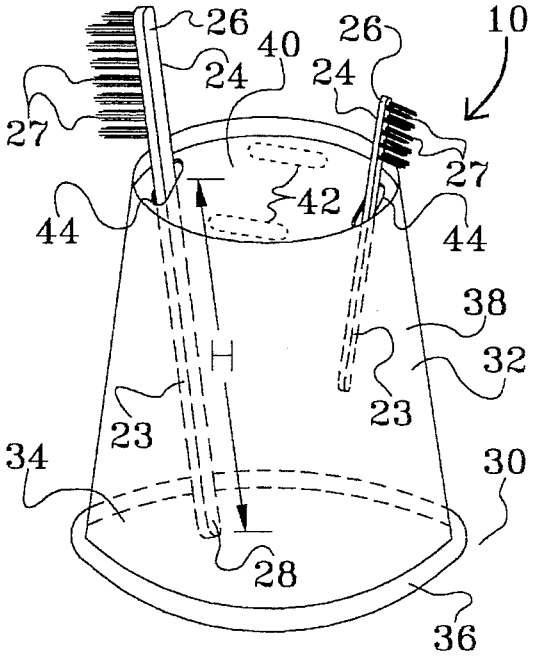
FIG. 4 is a similar perspective view as shown in FIG. 3 with an adult type of toothbrush and a child's toothbrush received through openings in the flat upper portion of the holder.

In FIG. 4, a similar perspective view of the holder 10 shown in FIG. 3 is illustrated. In this view, an adult size toothbrush 24 is shown standing upright in the holder 10 with the handles 23 shown in dotted lines extending through one of the holes 44. The lower end 28 is seen resting on top of the flat surface 30. Note the bristles 27 of this toothbrush 24 are free of any contact with the top of the holder 10. Also seen in the view is a child's toothbrush 24 extending through one of the holes 44. Obviously, the child's toothbrush 24 has a shorter handle and in this example the lower bristles 27 of the toothbrush 24 rest on a portion of the flat upper portion 40. Two of the annular shaped lines of weakness 42 in the flat upper portion 40 shown in this drawing are left undisturbed and could be used for making holes and receiving a third and four toothbrush handle therethrough.

It is important to note that the subject disposable and stackable toothbrush holder 10 as shown in the above drawings may have holes 22 and 44 already formed in the upper portions thereof or the lines of weakness 42 as described can be provided and the user of the holder 10 can form his or her own holes for receiving the toothbrush handle 23. An advantage of the holder 10 without preformed holes is the holder can easily be used as a drinking cup or with a mouth rinse prior to turning the holder 10 upside down and using it as a convenient sanitary toothbrush holder. Further, it should be mentioned that while two different embodiments of the subject invention are shown in the drawings, other geometric shapes and forms can be incorporated into the structure of the toothbrush holder without departing from the spirit and scope of the invention.

While the invention has been particularly shown, described and illustrated in detail with reference to the preferred embodiments and modifications thereof, it should be understood by those skilled in the art that equivalent changes in form and detail may be made therein without departing from the true spirit and scope of the invention as claimed, except as precluded by the prior art.

The embodiments of the invention for which an exclusive privilege and property right is claimed as defined as follows:

1. A disposable and stackable toothbrush holder in combination with a toothbrush for holding the toothbrush in an upright position, the holder comprising:

a toothbrush handle having a length "H" and a toothbrush head with bristles mounted at one end of said toothbrush handle;

an upside down cup having a lower portion, a middle portion, and an upper portion, said cup having a height "h" adapted for receiving a portion of the length "H" of said toothbrush handle therein; and annular lines of weakness in the upper portion of said cup for breaking through and forming an annular hole in a portion of the upper portion, said hole dimensioned and adapted for receiving said toothbrush handle therethrough;

whereby said upside down cup holds said toothbrush handle in an upright position and the height "h" of said cup is less than the length "H" of said toothbrush handle so that the bristles of said toothbrush head are held above said upside down cup to air dry after the use of the toothbrush.

2. The holder as described in claim 1 wherein the height "h" of said cup is in a range of 3 to 5 inches and the length "H" of said toothbrush handle is in a range of 5 to 7 inches.

3. The holder as described in claim 1 wherein the lower portion of said cup has a diameter in a range of 2½ to 4 inches, the diameter of the lower portion greater than a diameter of the upper portion of said cup so that said cup has a more stable base to prevent said cup and toothbrush from tipping over when in use.

4. The holder as described in claim 1 wherein the upper portion of said cup has a plurality of annular shaped lines of weakness for forming a plurality of annular shaped holes therein and receiving said toothbrush handle therethrough.

5. The holder as described in claim 1 wherein said cup is stackable when received on top of an identical shaped cup for ease in storage and shipping of the toothbrush holder.

6. The holder as described in claim 1 wherein said cup is formed into a cone shaped geometric configuration.

7. The holder as described in claim 1 wherein said cup is formed into a tapered cylindrical shaped geometric configuration.

8. A disposable and stackable toothbrush holder in combination with a toothbrush for holding the toothbrush in an upright position, the holder comprising:

a toothbrush handle having a length "H" in a range of 5 to 7 inches and a toothbrush head with bristles mounted at one end of said toothbrush handle;

an upper down cup having a lower portion, a middle portion, and an upper portion, said cup having a height "h" in a range of 3 to 5 inches and adapted for receiving a portion of the length "H" of said toothbrush handle therein; and a plurality of annular lines of weakness in the upper portion of said cup for breaking through and forming a plurality of spaced apart annular holes in the upper portion, said holes dimensioned and adapted for receiving said toothbrush handle therethrough;

whereby said upside down cup holds said toothbrush handle in an upright position and the bristles of said toothbrush head are held above said upside down cup to air dry after the use of the toothbrush.

9. The holder as described in claim 8 wherein the lower portion of said cup has a diameter in a range of 2½ to 4 inches, the diameter of the lower portion greater than a diameter of the upper portion of said cup so that said cup has a more stable base to prevent said cup and the toothbrush from tipping over when in use.

10. The holder as described in claim 8 wherein said cup is stackable when received on top of an identical shaped cup for ease in storage and shipping of the toothbrush holder.

11. The holder as described in claim 8 wherein said cup is formed into a cone shaped geometric configuration.

12. The holder as described in claim 8 wherein said cup is formed into a tapered cylindrical shaped geometric configuration.

* * * * *